US006245475B1

(12) United States Patent
Scharfe et al.

(10) Patent No.: US 6,245,475 B1
(45) Date of Patent: Jun. 12, 2001

(54) PROCESS OF SPRAY FORMING PHOTORECEPTORS WITH INK NOZZLES

(75) Inventors: Merlin E. Scharfe, Penfield; John M. Hammond, Ontario; Robert F. Dunham, Walworth; Jian Cai, Penfield; Kenny Tuan Dinh, Webster; Roger T. Janezic, Rochester, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/464,599

(22) Filed: Dec. 16, 1999

(51) Int. Cl.[7] ..... G03G 5/00

(52) U.S. Cl. ..... 430/127; 430/131; 430/132; 430/133; 430/134; 427/421; 427/424; 427/425

(58) Field of Search ..... 430/127, 131, 430/132, 133, 134; 427/421, 424, 425

(56) References Cited

U.S. PATENT DOCUMENTS 5,202,214 * 4/1993 Kawamorita et al. ..... 430/133
5,550,618 8/1996 Herbert et al. ..... 430/69
5,885,661 * 3/1999 Batchelder ..... 427/425
5,906,904 5/1999 Parikh et al. ..... 430/63

FOREIGN PATENT DOCUMENTS 2-272567 * 11/1990 (JP) ..... 430/127
5-181290 * 7/1993 (JP) ..... 430/127

* cited by examiner

*Primary Examiner*—Mark Chapman
(74) *Attorney, Agent, or Firm*—Oliff & Berridge, PLC

(57) ABSTRACT

A method of forming one or more polymer containing layers on a substrate using ink jet nozzles. The method is particularly suited to forming one or more polymer containing layers of a photoreceptor. The polymer containing layers may be formed by moving a substrate, in particular a cylindrical substrate, past the ink jet nozzles, by moving the ink jet nozzles over the substrate, or both. The ink jet nozzles are capable of being independently controlled in order to permit precise location of the coating on the substrate.

16 Claims, 5 Drawing Sheets

PROCESS OF SPRAY FORMING PHOTORECEPTORS WITH INK NOZZLES

BACKGROUND OF THE INVENTION

1. Field of Invention

This invention relates to a method of forming a photoreceptor by spray coating one or more layers of the photoreceptor using ink jet nozzles. More in particular, the invention relates to a method of forming one or more layers of a photoreceptor containing polymer binder by spray forming the layers with ink jet nozzles, and to a printing machine containing a photoreceptor so formed.

2. Description of Related Art

Manufacturing of organic photoconductor drums used in current laser or LED printers and copiers is accomplished almost exclusively by dip coating. Spray coating is also used, albeit on a limited basis, for example in forming Broad Organic Spectrum (BOS) photoreceptors.

U.S. Pat. No. 5,906,904, incorporated by reference herein in its entirety, describes an electrophotographic imaging member. In describing the imaging member, it is indicated in this patent that each of the layers of the imaging member may be formed by conventional techniques such as spraying, dip coating, draw bar coating, gravure coating, roll coating, and the like.

Numerous problems are encountered in the operation of conventional spray or dip coating processes. In particular, material related difficulties are among the more challenging problems that need to be addressed.

In the manufacture of a multi-layer drum photoconductor (OPC) by dip coating, large volumes of coating solutions are required for application of each layer. The respective solutions are held in storage tanks and recirculated through cylindrical reservoirs in which the drum substrates are immersed. For the simultaneous coating of multiple drums in a single operation, multiple reservoirs are fabricated in rectangular or circular arrays for the application of a single layer at a dip coating process station, it is typical to have a total volume of 20 to 100 gallons of coating solution recirculating continuously through the coating fluid delivery system. This is problematic with respect to maintaining inventory of a large volume of expensive materials, with risk of loss due to contamination, limited shelf life for a majority of coating formulations, and difficulty in maintaining steady state composition of the coating solution due to solvent evaporation.

Dip coating also has other operational problems. The process requires a bottom edge wiping process step for each layer coating. This step produces additional solvent vapor emissions, a liquid solvent waste stream, and slows the process cycle time. Alternative end cleaning processes such as laser ablation also have associated problems. Furthermore, dip coating photoreceptor devices have a thickness taper, commonly known as sloping, at the upper end of the substrate where the coating process is initiated.

The use of air spray coating for manufacturing photoreceptors, and the recent development of rotary atomization spray coating for wide format OPC drums, also possess material related problems. Transfer efficiencies may be as low as 20%, resulting in excessive material consumption and solvent vapor emissions per unit of production. The droplet size distribution of spray atomizing devices is broad, and the arrival of droplets at a substrate surface is chaotic. This results in a non-homogeneous, i.e., grainy, coated layer on a microscopic scale, and a mottled coating appearance on a macroscopic scale. The spray patterns for both air spray and rotary spray coating are fan shaped, and the spray fan must be scanned beyond the end of the substrate in order to achieve a uniform coating along the full length of the substrate. This thus requires that the ends of the substrate be masked or that an edge wiping step be used (with the disadvantages described above). In addition, the substrate fixture and hardware and the interior of the coating chamber must be periodically cleaned, which cleaning operations are difficult to perform without increasing cycle time and producing waste streams and/or vapor emissions.

U.S. Pat. No. 5,550,618 underscores the problems associated with conventional spray coating techniques. It is indicated therein that coatings applied by spray coating are often uneven, and that coatings having an uneven thickness do not have uniform electrical properties, thereby degrading the print quality.

Conventional spray coating processes, including rotary atomization spray coating processes, do not use ink jet nozzles in the process.

SUMMARY OF THE INVENTION

What is desired is a coating process which can be retrofitted into existing manufacturing facilities, provides greater materials formulation latitude, precise layer thickness uniforming, and low waste emissions in order to enable production of higher quality photoreceptors and more environmentally favorable photoreceptor manufacturing.

These and other objects are achieved by the present invention relating to a process of forming photoreceptors by forming desired layers of the photoreceptor using small fluid jets or spray nozzles. An ink jet nozzle array would be a particularly suitable device for the deposition of coatings in droplet form.

The process of the invention is thus one in which an ink jet array or assembly of arrays is positioned to an orientation which enables complete and uniform coating of a substrate, in particular a cylindrical drum substrate. The deposition of the coating can be precisely controlled so as to be applied only to the portion of the substrate surface which is intended to be coated. Thus, the object of the invention, as well as additional objects, are achieved by the present invention relating to a method of forming a photoreceptor or other printing machine roll comprising spray forming one or more polymer-based layers of the photoreceptor or roll by spraying the coating through ink jet nozzles onto a substrate, and subsequently drying the layer so spray formed. The invention also relates to a printing machine containing the photoreceptor and/or roll formed by the foregoing method.

BRIEF DESCRIPTION OF THE DRAWINGS

FIG. 5 is a top view of a polygonal ink jet coating apparatus, while

FIG. 7 is a top view of a circular ink jet coating apparatus, while

FIG. 9 is a top view of a helical ink jet coating apparatus, while

DETAILED DESCRIPTION OF PREFERRED EMBODIMENTS

In the invention, ink jet nozzles are used to spray form one or more polymer-based layers of the photoreceptor. The method can either be used to form photoreceptors in a batch process, i.e., form one photoreceptor at a time, or can be used to form photoreceptors in a continuous process, i.e., form a plurality of separate photoreceptors in the same operation.

Figure 1:
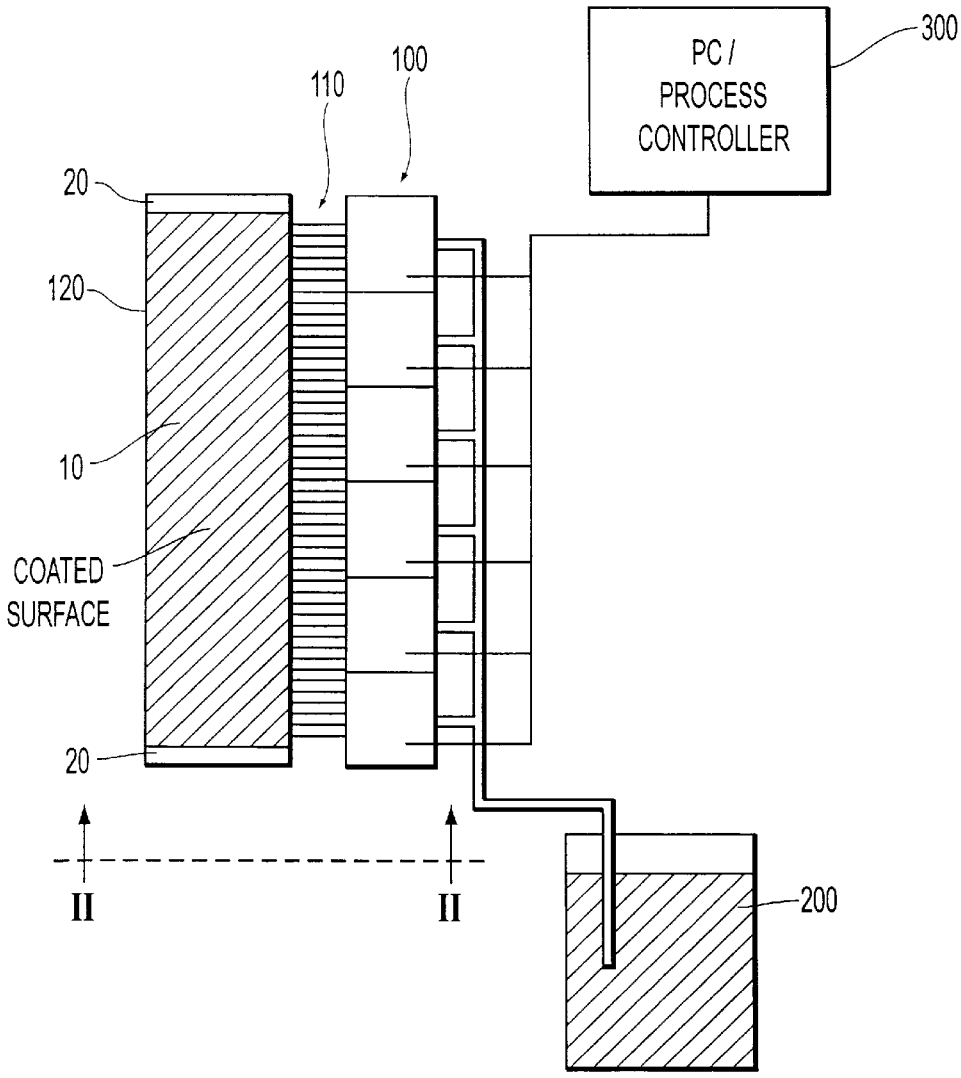
FIG. 1 illustrates a full width ink jet array assembly for coating a substrate.
Figure 2:
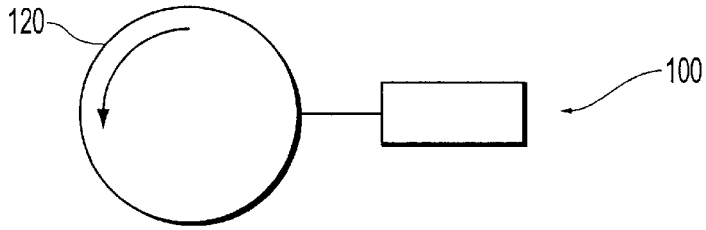
FIG. 2 is a sectional view of FIG. 1 taken along A—A.

A first embodiment of the present invention is illustrated in FIGS. 1 and 2. Referring to FIG. 1, a linear array of ink jets 100 approximately equal in length to the portion of the substrate 120 which is to be coated is positioned over the substrate surface. The ink jet array in this embodiment is thus referred to as a full width array. The array ejects droplet stream 110 to form a coated area 10 on the substrate. Areas 20 on the substrate are not coated. In FIGS. 1 and 2, the substrate is illustrated as a cylindrical drum substrate. However, it should be understood that the substrate can take other suitable forms, including that of a web or a belt. In the case of the drum substrate illustrated, the ink jet array 100 is positioned parallel to the axis of the drum substrate.

As can be seen from FIG. 1, the operation of the ink jet nozzles is controlled by PC/process controller 300. The coating materials are supplied to the ink jet nozzles 100 by a fluid delivery system 200.

The orientation of the drum substrate axis to the ink jet nozzles is preferably horizontal. The orientation of the ink jets with respect to the substrate is shown in FIGS. 1 and 2 such that the droplets are jetted horizontally. Alternatively, however, the droplets may be jetted vertically from above the substrate, or some other angular displacement between the horizontal and vertical planes. However, it is preferred that the jets not be oriented such that they must propel the droplets in an upward direction of the substrate since such may interfere with the formation of a uniform thickness coating upon a substrate.

In this embodiment of the invention employing a full width ink jet array, an individual substrate to be coated is first moved into position along the ink jet array. Movement of the substrate, in this case rotation of the drum substrate around its axis, is then begun such that the substrate begins moving past the ink jet array. The ink jets are then activated, thereby depositing droplets of the desired coating material on the surface of the substrate as it rotates.

The substrate is preferably rotated through at least one full revolution so that its entire surface is coated. It may be desirable to rotate the substrate past the ink jet array several times so that uniform coverage and leveling of the layer to the desired thickness is achieved. Following coating, the ink jets are deactivated so that the deposition of the coating material is stopped. The coated substrate is then moved from the coating operation to a drying operation, or on to subsequent layer coating stations before a final drying process is performed.

In activating and deactivating the ink jet heads, it may be desirable to operate the jets intermittently during these steps in a manner to enable a gradual transition to full jet activation and a gradual transition to full jet deactivation. In addition, it is preferred to perform the transitions of jet activation and jet deactivation on the same sectors of the substrate. In this manner, the most uniform layer thickness may be achieved, with minimal variation due to the activation and deactivation of the jets.

A major advantage of the present process is that individual ink jets, or small groups of ink jets, are discreetly addressable. In other words, each individual ink jet nozzle can be separately controlled. This permits precise control of the location of the coating upon the substrate, thereby eliminating the need for post-coating wiping operations and cleaning operations. Suitable ink jet control can be readily accomplished with ink jet nozzle operating software currently available for use in many industrial applications.

As processes and devices suitable for handling the substrate for the coating operation are well known in the art, details of the substrate handling process need not be detailed herein. Any suitable devices for handling the substrate without damaging the coatings thereon may be used.

It will be apparent to one of ordinary skill in the art that the above coating process can be configured with multiple coating stations operating parallel such that batches of substrates may be coated simultaneously. Such batches of substrates could be arranged in either horizontal or vertical plane arrays, three dimensional rectangular arrays, circular arrays, etc.

In this embodiment, the ink jet nozzles can be arranged in the full width array of a single, extended length ink jet head. Alternatively, a plurality of smaller arrays could be positioned end-to-end to cover the desired full width of the substrate. In this latter case, in the event that the arrays can not be abutted sufficiently close together to uniformly coat the substrate at portions between the individual arrays, the entire multi-array assembly could be oscillated slightly in the direction of the drum substrate axis at an amplitude on the order of the gap between the arrays, and at a frequency several times greater than the jet operating frequency. Further, a micropositioning device could increment the array assembly in the axial direction by a small fraction of the gap between arrays as a substrate revolution is completed. Doing so will ensure that the entire width of the substrate is coated with a uniform coating by the ink jet array.

Also in the event that jet spacing is not sufficiently close to allow complete contact, coalescence and leveling of the coating deposited by each individual jet, the foregoing techniques could be used to facilitate the coalescence and leveling processes. Alternatively, each of the individual ink jet arrays could be skewed with respect to the substrate axis in order to allow for complete coating.

It should be further understood by one of ordinary skill in the art that multiple ink jet array assemblies could be positioned in proximity to the substrate and operated either sequentially to coat multi-layer devices at a single processing station or in parallel to coat individual layers of mixed composition, such as blend pigment charge generator layers. If the spot resolution of the jets is sufficiently high, discreet patterns could be printed in the coating layers. For example, it is possible to coat an undercoat or subbing layer which would eliminate "plywood" in laser exposed page printer output.

In this first embodiment, the angular velocity (i.e., rotational speed) of the substrate can be set as desired in conjunction with the coating application rate in order to ensure formation of the coating to the desired thickness. As the desired thickness for different layers of a photoreceptor may vary, the angular velocity may also vary. Suitable angular velocities could be readily determined by practitioners in the art. For example, the angular velocity may be from 5 to 50 rpm, more preferably 10 to 30 rpm.

Figure 3:
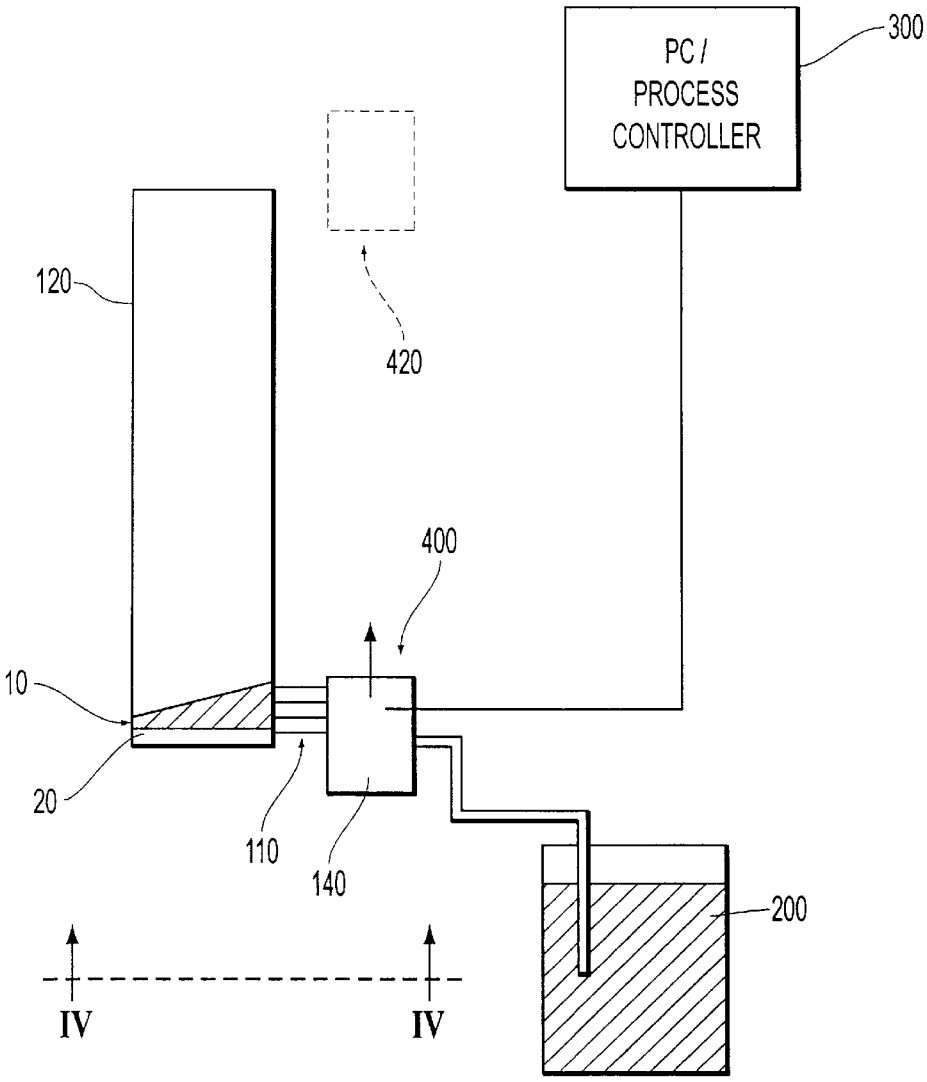
FIG. 3 illustrates a partial width ink jet array assembly for spray coating a substrate.
Figure 4:
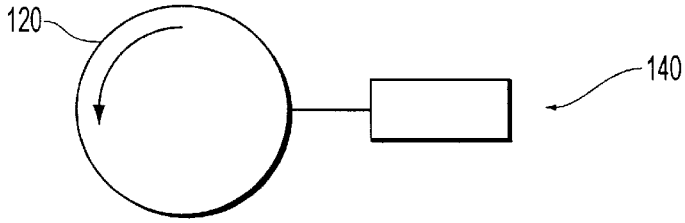
FIG. 4 is a sectional view of FIG. 3 taken along section B—B.

In a second embodiment of the present invention, illustrated in FIGS. 3 and 4, the ink jet array is not a full width array as in the embodiment illustrated in FIGS. 1 and 2, but is instead only a partial width array. In other words, the ink jet array has a length less than the width of the substrate to be coated. In FIG. 3, partial width array 140 is shown in relation to the substrate 120 to be coated.

In this embodiment, an individual substrate is first moved into position along the ink jet array as in the first embodiment, and rotation of the drum substrate around its axis is started. Coating of the substrate begins with the ink jet array located in the starting position 400 as illustrated in FIG. 3. Starting position 400 represents the dividing point on the substrate between portion 10 to be coated and portion 20 not to be coated. At this starting position 400, the individual ink jets over a portion 10 of the substrate to be coated are activated, depositing droplets 110 on the surface of the substrate at such portion as it rotates. As the substrate is rotated, the ink jet array is moved across the surface of the substrate or along the axis of the drum substrate. When the ink jet array reaches the desired finishing position 420 as shown in FIG. 3, which represents the dividing point on the substrate between portion 10 to be coated and portion 20 not to be coated, the ink jets are deactivated and deposition of the coating is stopped. As in the first embodiment, the substrate is then moved from the coating operation to a drying operation or onto subsequent layer coating stations before a final drying process is performed.

In activating the jets, it is preferable to operate only a portion of the jets initially as shown in FIG. 3. More specifically, individual jets should be activated as they move directly into alignment with the portion 10 of the surface to be coated. In this manner, a sharp borderline between the uncoated edge 20 of the substrate and the coated portion 10 of the substrate can be produced without the need for an edge wiping step, or the fitting of a mask to the edge of the substrate.

In like manner, in the jet deactivating step, when the ink jet array approaches its final finishing position near the end of the substrate, the individual jets should be shut off in sequence as they move beyond the outermost portion 10 of the drum to be coated in order to produce a sharp termination of the coating at the other end of the substrate. As in the first embodiment discussed above, such control of the ink jets eliminates the need for post-coating wiping operations or pre-coating masking operations.

Furthermore, it may also be desirable to operate the jets near the outer edge of the array assembly intermittently, and to appropriately select the substrate rotational speed and the array traversal velocity such that in the areas on the substrate where a partial overlap of the jet spray pattern occurs, a constant layer thickness is attained. Because individual ink jets, or small groups of ink jets if desired, are discreetly addressable, the jet control required to enable a distinct coating boundary at the ends of the substrate and an overall uniform coating thickness can be easily accomplished with jet nozzle operating software.

In this embodiment, it is preferable to specify the angular velocity of the substrate and the linear velocity of the ink jet array such that any point on the surface of the substrate rotates past the ink jets several times in order to facilitate uniform coverage and leveling of the layer to the desired thickness. Here again, the individual control of these parameters, as well as the individual control of the ink jets, permit formation of layers of uniform thickness upon the substrate.

The angular velocity of the substrate may be the same as discussed above in the first embodiment. Suitable linear velocities for the ink jet array can readily be determined by one of ordinary skill in the art with respect to the thickness of the coating desired. Suitable linear velocities may be, for example, 1–100 mm/min, more preferably 5–50 mm/min.

In order to achieve the end desired thickness of the coating to be formed, the array may be scanned back and forth over the substrate in several passes.

In the embodiment of FIG. 1 discussed above, coating of the substrate is effected by rotating the substrate past the full width array of ink jets. In the second embodiment of FIG. 3, coating is effected by not only rotating the substrate past the array of ink jets, but also by moving the array over the substrate, for example along an axis of a cylindrical or drum substrate. These types of processes are most suitable for batch processing. The additional embodiments described below are suitable for either batch or continuous processing.

In further embodiments of the invention illustrated in FIGS. 5–10, a circumferential array of ink jets is used to coat a polymer based film upon the substrate. These embodiments are thus specifically directed to the coating of cylindrical substrates. In this embodiment, the circumferential array of ink jets may be moved along the axis of a stationary cylindrical substrate, the cylindrical substrate may be moved along its axis past the stationary circumferential array of ink jets, or both. Rotation of the cylindrical substrate about its axis might also be effected, if desired, for example where the array does not encompass the entire circumference of the cylindrical substrate.

Figure 5:
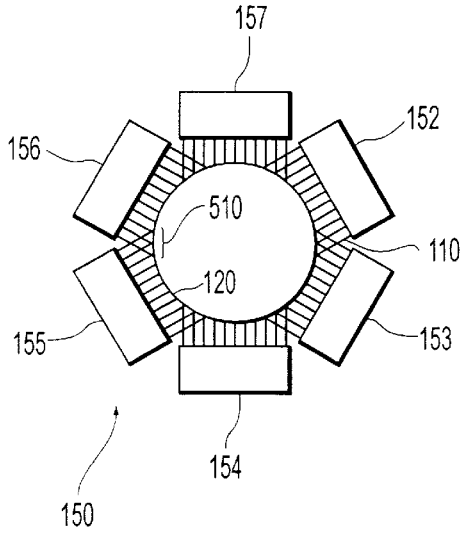
Figure 6:
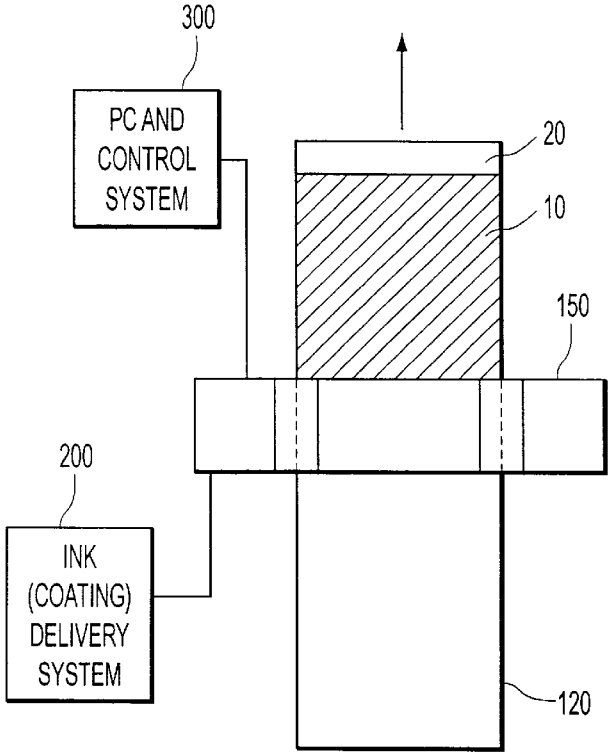
FIG. 6 is a side view of the polygonal ink jet coating apparatus.
Figure 7:
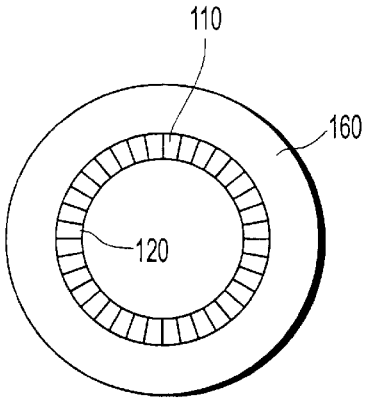
Figure 8:
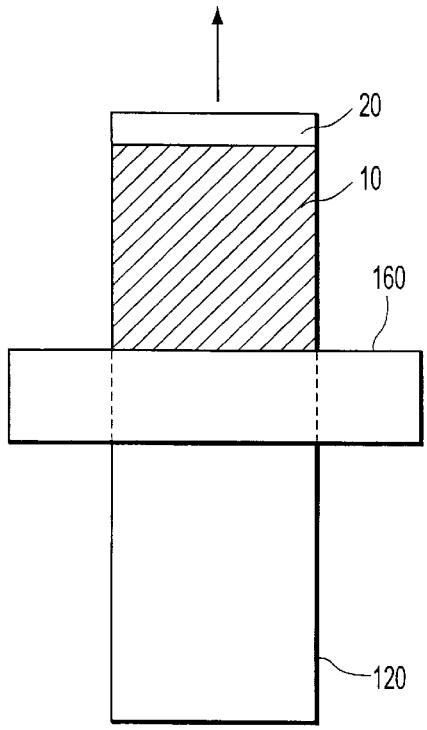
FIG. 8 is a side view of the circular ink jet coating apparatus.
Figure 9:
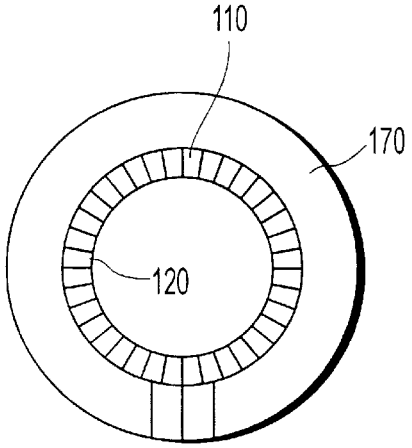
Figure 10:
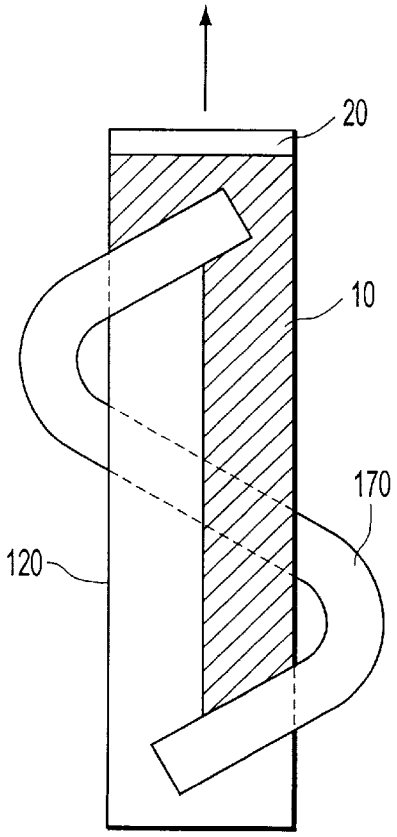
FIG. 10 is a side view of the helical ink jet coating apparatus.

In these embodiments, the ink jets are positioned around the circumference of the cylindrical substrate in a manner which enables a coating to be applied as the ink jets and/or substrate are moved relative to each other, preferably along the axial direction of the cylindrical substrate. Among the embodiments enabling application of a coating in this manner are (1) an assembly of multiple jet arrays joined in a polygon shape with the jets directed at the substrate surface as shown in FIGS. 5 and 6, (2) a circular array of jets directed at the substrate surface as shown in FIGS. 7 and 8, and (3) a helical array of jets directed at the substrate as shown in FIGS. 9 and 10. Each of these embodiments is discussed below.

In the embodiment shown in FIGS. 5 and 6, the ink jets are composed of an assembly of multiple ink jet arrays joined in a polygonal shape. The polygonal ink jet arrays 150 are composed of a plurality of ink jet arrays 152, 153, 154, 155, 156 and 157, each directed substantially towards the surface of the cylindrical substrate 120. The arrays are held in close proximity to the surface of the cylinder and are positioned relative to each other such that they form approximately a polygon shape, the central axis of which is coaxial with the axis of the cylindrical substrate. The control system 300 and coating delivery system 200 may be the same as discussed above. In addition, this embodiment involves means to move the cylindrical substrate and the ink jet array relative to each other along the axis of the cylindrical substrate and means to move the cylindrical substrate in a position to be coated and subsequently on through a film drying operation. Such means are readily known to those of ordinary skill in the art, and are thus not further described herein.

In the embodiment of FIGS. 5 and 6, the ink jet array assembly is shown to be comprised of six individual ink jet arrays arranged in a hexagonal shape. A greater or lesser number of individual arrays may be used as needed. However, it is preferable that at least three individual ink jet arrays be used in surrounding circumference of the substrate.

Between each of the arrays, it is seen that a zone of the droplet stream 110 overlaps at portion 510 where the substrate surface receives coating from each of the two nearby ink jet arrays. However, because individual jets or groups of jets are discreetly addressable as discussed above, the jets which coat the overlap zones are preferably operated intermittently such that their combined output at any point within the jet overlap zone 510 is coated at the desired thickness. Again, this can be readily accomplished with available ink jet operating software.

In this embodiment, in order to coat the full length of a cylindrical substrate, the ink jet array assembly is scanned in the axial direction along the portion of the substrate to be coated. More specifically, this embodiment would begin with an individual substrate being moved into position at a starting position for coating. The ink jets are then activated, depositing droplets 110 on the surface of the substrate beginning at the starting position (which position is typically near the substrate end), which in this case is shown in FIG. 6 as the dividing line between uncoated area 20 and coated area 10. The substrate is then moved along its axis, and coating is applied as the substrate passes through the polygonal shaped jet arrays. Alternatively, the jet arrays could be moved axially, and the substrate held stationary. Once a substrate has passed through the polygonal array to the desired end point of the coating, the ink jets are then deactivated and deposition of the coating is stopped. If desired, the array may be passed back over the substrate as many times as necessary to achieve the final coating thickness. The substrate can then be moved from the coating operation to a drying operation, or on to subsequent layer coating stations before a final drying process is performed.

The foregoing steps could be performed on individual cylindrical drums such that the coating process operates in a batch mode, or the process can be operated continuously, i.e., a continuous supply of substrates is conveyed end-to-end past the jet arrays, with the jets started and stopped as required to provide uncoated portions between the individual substrates. Such continuous operation of the process may require that small spacers be placed between the substrates in order to maintain steady process operation and accurate coaxial positioning of the substrates.

A similar embodiment of the use of a polygonal array of linear ink jets is the use of a circular ink jet array 160 as shown in FIGS. 7 and 8. In this embodiment, the steps to apply coatings to cylindrical substrates would be substantially the same as discussed above with respect to the use of a polygonal array, although the need for control of the individual arrays at overlap portions could be eliminated, since a circular array would have no overlapping jets.

In a still further embodiment, the ink jet array or assembly of arrays could be configured around the cylindrical substrate in a helical arrangement, for example as shown in FIGS. 9 and 10. Helical ink jet array 170 could be comprised of individual jet arrays butted end-to-end, or comprised of a continuously curved single array. In either arrangement, the axis of the helix would be substantially colinear with the axis of the cylindrical substrate, and the helix would preferably form at least one complete 360° rotation around the substrate, enabling the entire surface of the substrate to be coated.

Here again with the use of a helical ink jet array, the steps for applying a coating to the cylindrical substrate would be similar to those for coating with the polygonal array as discussed above. However, a significant difference would be in the operation of the individual ink jets. In the use of a helical array, the jets would not be actuated and deactuated simultaneously. Instead, the individual jets would need to be activated and deactivated in sequence such that the desired uncoated areas at the ends of the substrates were not covered with coating fluid. Here again, such control is permissible with the use of ink jets, and can be readily accomplished with available ink jet operating software.

In all of the foregoing embodiments, the use of ink jets to apply coatings or layers to the substrate enables precise control of the location of the coating on the substrate, as well as precise control of the thickness of the coating. Such control eliminates the need for post-coating wiping operations as well as pre-coating masking operations, thereby greatly improving the efficiency of the process. Also, time consuming clean up is avoided, as is the occurrence of excessive vapor emissions.

The ink jets used in this invention may be any ink jet conventionally used in document printing and industrial marking processes. A variety of known ink jet technologies may be used in the ink jet array, including thermal ink jet, electrostatic ink jet, piezo ink jet, and the like. Piezo ink jets may be preferred. A preferred system is available from Trident Corporation under the trade name Ultrajet. Printheads from Leader Corp. might also preferably be used. Most preferably, ink jets to be used should be capable of forming droplets of a fairly uniform size, for example on the order of 10–100 picoliters per drop, preferably 25–50 picoliters per drop.

The ink jet array is preferably sized and operated such that it is capable of depositing between 0.5 and 20 $cm^3$/min of coating fluid upon a substrate of between 2 and 10 cm in diameter. It is also preferred that when the ink jet array is not in operation, such as during substrate handling process steps, the ink jet array is moved to an idle position, wherin the jets are protected by a sealing device in order to prevent solvent evaporation from the individual jets. Such a practice is well known in ink jet device operation.

In the present invention, coating materials should be formulated to enable drying at temperatures of between 50 and 200° C. Thus, preferred coating solutions are preferably formulated using tetrahydrofuran (THF), toluene, n-butyl acetate, cyclohexanone, diacetone alcohol, and the like. Toluene, n-butyl acetate, and cyclohexanone are favorable solvents, enabling drying of the layer without the formation of bubbles, and operation of the ink jet array without excessive solvent evaporation and associated jet plugging. Typical drying times of coatings are preferably on the order of 30 seconds to 5 minutes.

A variety of drying processes and equipment can be used to dry the coatings. A preferred process is an air ring cluster type drying system. This system is a heated air ring type set up wherein the drum would be exposed to hot (greater than 120° C.), low velocity air as soon as possible after the coating application. This drying operation eliminates sag and maximizes quality and minimizes cycle times, thus enabling lower cost fabrication.

The foregoing processes are applicable to the formation of polymer containing films upon a substrate. For example, in the formation of a photoreceptor, the process could be used to form any of the polymer-containing layers of the photoreceptor, for example those layers utilizing a polymer as a binder for the layer. Such layers of the photoreceptor may include any of an anti-curl coating, a supporting substrate, a hole blocking layer, an adhesive interface layer, a charge generator (i.e., photo generating or photo conductive) layer, a charge transport layer, or a protective overcoat layer.

The anti-curl layer may be comprised of a polycarbonate such as Makrolon or a copolyester resin such as Vitel PE-200, and may contain 0 to 10 percent by weight silica. The anti-curl layer may have a thickness of from, for example, 1 to 30 microns.

In some photoreceptors, a supporting substrate layer may be formed of organic materials, for example MYLAR or polyethylene terephthalate. The thickness of this layer may be from, for example, about 1 to 100 microns.

An electron or hole blocking layer may comprise any suitable material. Typical hole blocking layers may include, for example, polyamides, hydroxy alkyl methacrylates, nylons, gelatin, hydroxylalkylcellulose, organopolyphosphazines, organosilanes, organotitanates, organozirconates and the like. Hole blocking layers typically have a thickness of 1 micron or less.

An adhesive interface layer may be applied to the hole blocking layer. The adhesive layer may comprise any suitable film forming polymer such as, for example, co-polyester resins, polyarylates, polyurethenes, etc. The adhesive interface layer may have a thickness of from 50 to about 2,000 Angstroms.

Charge generating layers typically comprise photoconductive materials dispersed in a polymeric binder. Typical photoconductive materials include, for example, phthalocyanines, perylenes, trigonal selenium, aromatic quinones, and the like. Any suitable film formed binder may be used in the charge generating layer including, for example, polyvynyl butyral, polycarbonates, acrylate polymers, vinyl polymers, cellulose polymers, polyesters, polysiloxanes, polyamides, polyurethanes, epoxies and the like. Generally, the charge generating layer will have a thickness of from 0.05 microns to about 30 microns or more.

The charge transport layer can be comprised of various components providing, for example, that they effectively transport charges (holes). Preferred charge transport layers comprise an aryl amine compound dispersed in a polymeric binder such as polycarbonate. The charge transport layer typically has a thickness of from about 2 to about 80 microns.

Of course, the foregoing list of example polymers for the various layers of the photoreceptor is not intended to be exhaustive. Numerous suitable materials and polymer binders are known in the art, for example as described in U.S. Pat. No. 5,906,904, incorporated herein by reference in its entirety.

In preparing the coating materials for application with the ink jets, the coatings are preferably prepared so as to have a suitable viscosity for application by ink jets. For best coating performance, the solutions for coating preferably have a nearly Newtonian shear viscosity and a slightly extensional thickening viscosity. These properties assist in stabilizing droplet formation by the ink jets as well as enable uniform film coating upon the substrate. Coating solutions are formulated such that they have a viscosity of between 2 and 50 centipoise, and preferably between 5 and 15 centipoise; and surface tension less than 35 dynes/cm; and, if pigment or other particles are present, a maximum particle size (diameter or other characteristic dimension) of one micron. Solids concentration in the coating solution is preferably between 1 and 10 percent by weight.

In addition, it should be apparent to those of ordinary skill in the art that the present invention can be used to not only fabricate photoreceptors, but also to fabricate other cylindrical thin film devices such as fuser rolls and donor rolls (for example, scavengeless electroded donor rolls) that also require the formation of polymer containing films upon the cylindrical substrate. The polymer containing materials of these additional items are well known in the art, and are thus not further described herein.

The photoreceptors of the present invention are suitable for use in print machines, in particular electrostatographic or electrophotographic print machines. As known in the art, such photoreceptors are used in print machines in order to form a latent image thereon, which latent image is developed with a toner or developer and ultimately transferred to an image-receiving substrate.

The invention is further described by way of the following example.

EXAMPLE

This example demonstrates formation of a charge generator layer of a photoreceptor by spray coating with ink jets. The undercoat layer of the photoreceptor was first formed by a conventional dipping technique on a drum substrate. A charge generator layer (CGL) dispersion is loaded into an empty ink cartridge which is connected to a print head. The CGL dispersion comprises 60 solids weight percent pigment hydroxy gallium phthalocyanine (HOGaPc), 40 solids weight percent binder (polyvinylbutyral B76 by Monsanto Corp.) in n-butyl acetate and cyclohexanone at a 1:1 volume ratio. The total solids weight percent of the solution is 3.5 percent. The CGL solution has a viscosity of 5.25 cP with an average particle size of 278 plus or minus 20 nm.

The CGL dispersion is jetted in the form of droplets having a size of 30–40 picoliters per drop through a piezo electrical print head available from Leader Corp.

A 30 mm outside diameter drum having the undercoat layer thereon is rotated at 20 rev/min, with the print head at 1 cm from the drum surface traversing across the surface of the drum at 10 mm/min. In this example, a total of five scannings of the print head back and forth over the surface are made in order to deposit the CGL. A charge generator layer having a thickness of about 5 to 6 microns results, which layer is visually uniform without any color gradient.

A conventional charge transport layer is then coated upon the CGL by a conventional dipping technique.

Figure 11:
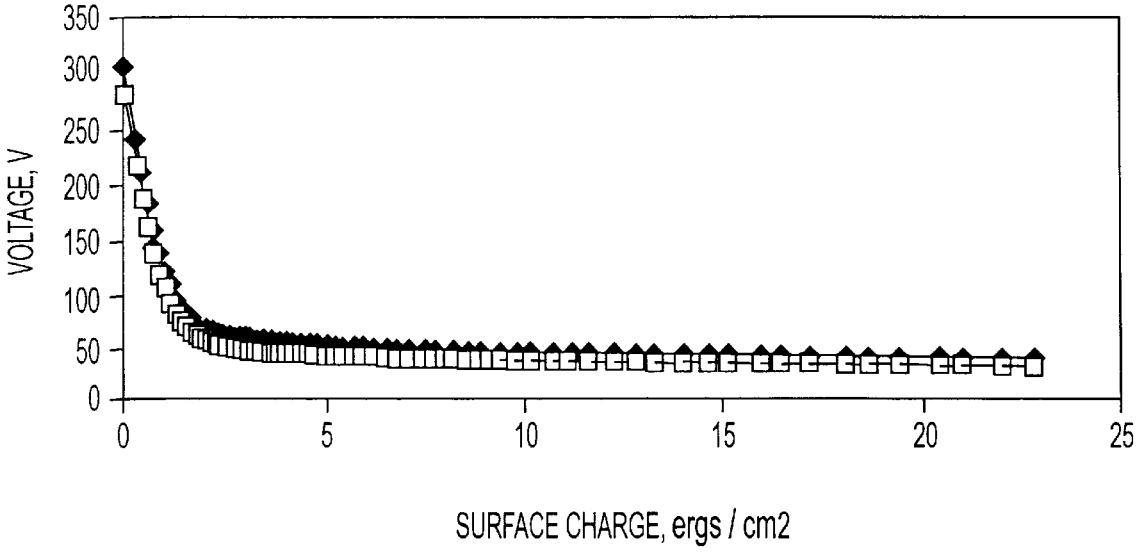
FIG. 11 is a charging and discharging PIDC of an ink jetted CGL photoreceptor.

The photoreceptor drum is then electrically scanned. FIG. 11 shows the charging and discharging curves of the drum utilizing standard testing conditions and procedures known in the art.

This example demonstrates that a photoreceptor can be formed by spray coating with ink jet nozzles to form a photoreceptor having acceptable performance properties.

What is claimed is:

1. A method of forming a photoreceptor, comprising spray forming one or more layers of the photoreceptor containing polymer by spraying a coating material containing the polymer through ink jet nozzles onto a substrate, wherein the substrate is a drum and wherein the ink jet nozzles are arranged circumferentially around the entire circumference of the drum, and subsequently drying the one or more layers so spray formed.

2. The method according to claim 1, wherein the spray forming comprises spraying the one or more layers onto the substrate while the substrate moves past the ink jet nozzles.

3. The method according to claim 2, wherein the substrate moves past the ink jet nozzles by rotating.

4. The method according to claim 3, wherein the ink jet nozzles are arranged so as to cover the entire width of the substrate.

5. The method according to claim 3, wherein the ink jet nozzles only partially cover the width of the substrate, and wherein the ink jet nozzles are moved across the width of the substrate as the substrate rotates past the ink jet nozzles.

6. The method according to claim 2, wherein the drum has an axis, and the drum moves past the ink jet nozzles by moving in the direction of the axis.

7. The method according to claim 1, wherein the ink jet nozzles are arranged in a circular array or a polygonal array.

8. The method according to claim 1, wherein the substrate is stationary, and the spray forming comprises moving the ink jet nozzles over the substrate during the spray forming.

9. The method according to claim 1, wherein the ink jet nozzles are arranged helically around the entire circumference of the drum.

10. The method according to claim 1, wherein the method is conducted continuously to form a plurality of photoreceptors.

11. The method according to claim 1, wherein the one or more layers containing polymer are selected from the group consisting of an anti-curl layer, a supporting substrate layer, a hole blocking layer, a charge generator layer, a charge transport layer, and a protective layer.

12. A method according to claim 1, wherein individual ink jet nozzles are independently controlled during the spray forming to precisely locate the one or more layers of the photoreceptor on the substrate.

13. A method of forming one or more polymer containing layers of a photoreceptor, a donor roll or a fuser roll, comprising spray forming the one or more polymer containing layers on a cylindrical substrate of the photoreceptor, donor roll or fuser roll by spraying through a plurality of individual ink jet nozzles of an ink jet array, wherein the ink jet nozzles are arranged circumferentially around the entire circumference of the cylindrical substrate and subsequently drying the layers so spray formed.

14. The method according to claim 13, wherein the individual ink jet nozzles are independently controlled during spray forming to precisely locate the layer upon the substrate.

15. The method according to claim 13, wherein the plurality of ink jet nozzles are arranged in a circular array or a polygonal array.

16. The method according to claim 13, wherein the plurality of ink jet nozzles are arranged helically around the entire circumference of the cylindrical substrate.

* * * * *